US008348413B2

(12) United States Patent
Doo

(10) Patent No.: US 8,348,413 B2
(45) Date of Patent: Jan. 8, 2013

(54) INK JET RECORDING APPARATUS EQUIPPED WITH ULTRAVIOLET LIGHT IRRADIATION DEVICE THAT MOVES WITH INK HEAD

(75) Inventor: Harumichi Doo, Hamamatsu (JP)

(73) Assignee: Roland DG Corporation, Hamamatsu-Shi (JP)

( * ) Notice: Subject to any disclaimer, the term of this patent is extended or adjusted under 35 U.S.C. 154(b) by 518 days.

(21) Appl. No.: 12/512,941

(22) Filed: Jul. 30, 2009

(65) Prior Publication Data

US 2011/0025736 A1 Feb. 3, 2011

(51) Int. Cl.
*B41J 2/01* (2006.01)

(52) U.S. Cl. ..... 347/102; 347/23

(58) Field of Classification Search ..... 347/102, 347/23

See application file for complete search history.

(56) References Cited

U.S. PATENT DOCUMENTS 6,092,890 A * 7/2000 Wen et al. ..... 347/101
6,561,640 B1 * 5/2003 Young ..... 347/102
2004/0021726 A1 * 2/2004 Obertegger et al. ..... 347/29
2004/0114016 A1 * 6/2004 Yokoyama ..... 347/102
2004/0189728 A1 * 9/2004 Nakajima ..... 347/14
2004/0223028 A1 * 11/2004 Yokoyama et al. ..... 347/23
2005/0099478 A1 * 5/2005 Iwase ..... 347/102
2005/0225595 A1 * 10/2005 Ohmori et al. ..... 347/37

FOREIGN PATENT DOCUMENTS

JP 2003127347 A * 5/2003

* cited by examiner

*Primary Examiner* — Charlie Peng
*Assistant Examiner* — Peter Radkowski
(74) *Attorney, Agent, or Firm* — Lee, Hong, Degerman, Kang & Waimey

(57) ABSTRACT

An ink jet recording apparatus is provided. The ink jet recording apparatus includes a supporting member for supporting a recording medium, an ink head comprising a nozzle surface disposed opposite the recording medium during a print operation, an ultraviolet light irradiation device coupled to the ink head in a freely movable manner, an ink head aiding system comprising a plurality of elements including at least a wiper for wiping the nozzle surface of the ink head or a cap for covering the nozzle surface of the ink head, and at least a portion of the irradiation section of the ultraviolet light irradiation device is located in front of at least one of the elements of the ink head aiding system.

21 Claims, 20 Drawing Sheets

INK JET RECORDING APPARATUS EQUIPPED WITH ULTRAVIOLET LIGHT IRRADIATION DEVICE THAT MOVES WITH INK HEAD

BACKGROUND OF THE INVENTION

1. Field of the Invention

The present invention relates to an ink jet recording apparatus equipped with an ink head that ejects ultraviolet light curable ink and an ultraviolet light irradiation device that moves with the ink head.

2. Discussion of the Related Art

An ink jet recording apparatus that discharges ultraviolet light curable ink from the ink head is known in the art, for example, U.S. Pat. No. 7,232,212. The ink jet recording apparatuses may also be equipped with a device for irradiating ultraviolet light to cure the ink which has been discharged from the ink head on a recording medium. The ultraviolet light irradiation device may irradiate ultraviolet light over the entire region of the recording medium in the left-right direction.

As described in U.S. Pat. No. 7,232,212, an ultraviolet light irradiation device that is attached to an ink head and is carried with the ink head in the left-right direction is also known in the art. The aforementioned ultraviolet light irradiation device is capable of irradiating ultraviolet light on a desired portion of the recording medium, thereby suppressing unnecessary irradiation of ultraviolet light.

It is noted that ink dries upon contact with the air. However, the viscosity of the ink increases when ink within a nozzle dries, and therefore the ejection performance of the ink head may diminish. Also, ink adhered to the nozzle surface may solidify, thereby further diminishing the ejection performance of the ink head. Therefore, an ink jet recording apparatus is provided with a system for maintaining the performance of the ink head, and may also be referred to as an ink head aiding system.

For example, U.S. Pat. No. 7,232,212 describes a capping device equipped with a cap for covering the nozzle surface. The capping device prevents the ink from drying within the nozzle.

In the ink jet recording apparatus with ultraviolet light curable ink which is known in the art, the ultraviolet light irradiation device may light up in unintended moments due to a deficiency in the control program. It is noted that the ultraviolet light irradiation device moves to a position adjacent to or above the ink head aiding system when the ultraviolet light irradiation device moves with the ink head. Therefore, the ultraviolet light irradiation device may irradiate ultraviolet light to the ink head aiding system in an unintended moment. Ink within the ink head aiding system would immediately be cured if ultraviolet light is irradiated on the ink head aiding system. Thus, it would be difficult for the ink head aiding system to perform its original function, and consequently, it becomes difficult to maintain the performance of the ink head.

SUMMARY OF THE INVENTION

Features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In accordance with an embodiment, an ink jet recording apparatus is presented. The ink jet recording apparatus includes a supporting member for supporting a recording medium, a first transfer mechanism for transferring the recording medium supported by the supporting member in a first direction, a guide rail extending in a second direction and comprising an end section that extends beyond the supporting member in the second direction, an ink head comprising a nozzle surface disposed opposite the recording medium during a print operation, at least one nozzle formed in the nozzle surface for ejecting ultraviolet light curable ink, wherein the ink head engages the guide rail in a freely movable manner in the second direction along the guide rail, a second transfer mechanism that transfers the ink head in the second direction, an ultraviolet light irradiation device coupled to the ink head in a freely movable manner in the second direction, and comprising an irradiation section disposed opposite to the recording medium during the print operation for irradiating ultraviolet light onto the ultraviolet light curable ink discharged on the recording medium, and an ink head aiding system comprising a plurality of elements including at least a wiper for wiping the nozzle surface of the ink head or a cap for covering the nozzle surface of the ink head, wherein at least a portion of the irradiation section of the ultraviolet light irradiation device is located in front of at least one of the elements of the ink head aiding system.

According to one feature, the entire irradiation section of the ultraviolet light irradiation device is located at the front of at least one of the elements of the ink head aiding system. Additionally, the ink head aiding system further comprises a container for collecting ink ejected from the ink head.

According to another feature, a length in the first direction between a rear end of the irradiation section of the ultraviolet light irradiation device and a front end of the nozzle surface of the ink head is greater than a minimum feed amount of the recording medium.

According to yet another feature, the first direction is a front-rear direction, and the second direction is a left-right direction.

In accordance with another embodiment, an ink jet record apparatus is presented. The ink jet recording apparatus includes a supporting member for supporting a recording medium, a first transfer mechanism for transferring the recording medium supported by the supporting member in a first direction, a guide rail that extends in a second direction and comprising an end section that extends beyond the supporting member in the second direction, an ink head comprising a nozzle surface disposed opposite the recording medium during a print operation, at least one nozzle formed in the nozzle surface for ejecting ultraviolet light curable ink, wherein the ink head engages the guide rail in a freely movable manner in the second direction along the guide rail, a second transfer mechanism for transferring the ink head in the second direction, first and second ultraviolet light irradiation devices coupled to the ink head in a freely movable manner, and comprising irradiation sections disposed opposite to the recording medium during the print operation, wherein the irradiation sections irradiate ultraviolet light onto the ultraviolet light curable ink discharged on the recording medium, and an ink head aiding system comprising a plurality of elements including at least a wiper for wiping the nozzle surface of the ink head or a cap for covering the nozzle surface of the ink head, wherein at least a portion of the irradiation section of the second ultraviolet light irradiation device is located in front of the irradiation section of the first ultraviolet light irradiation device, and at least a portion of the irradiation section of the second ultraviolet light irradiation device is located in front of at least one of the plurality of elements of the ink head aiding system.

In accordance with yet another embodiment a method of printing via an ink jet recording apparatus is presented. The method includes supporting a recording medium via a supporting member, transferring the recording medium via a first transfer mechanism in a first direction, ejecting ultraviolet light curable ink via at least one nozzle formed in a nozzle surface of an ink head disposed opposite the recording medium during a print operation, wherein the ink head engages a guide rail extending in a second direction, and wherein the ink head moves along the guide rail in a freely movable manner via a second transfer mechanism in the second direction, irradiating ultraviolet light onto the ultraviolet light curable ink discharged on the recording medium via an irradiation section of an ultraviolet light irradiation device coupled to the ink head and disposed opposite to the recording medium during the print operation, and changing the ultraviolet light irradiation device from a light-on state to a light-off state when the ink head moves from a position opposing the supporting member and before at least a portion of the irradiation section of the ultraviolet light irradiation device reaches a position opposing at least one element of an ink head aiding system.

DESCRIPTION OF THE PREFERRED EMBODIMENTS

In the following detailed description, reference is made to the accompanying drawing figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts.

Figure 1:
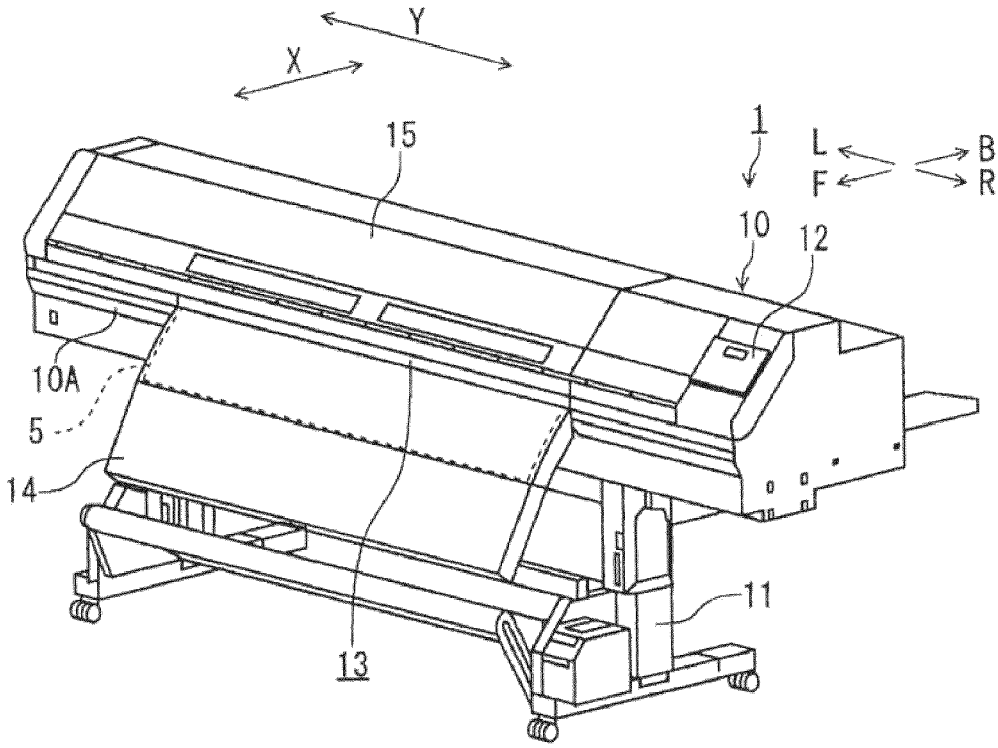
FIG. 1 is a perspective view of an ink jet printer according to an embodiment of the present invention.

FIG. 1 illustrates an ink jet recording apparatus, such as ink jet printer 1, in accordance with an embodiment of the invention. Nevertheless, the ink jet recording apparatus in accordance with the present embodiment is not limited to the ink jet printer 1 and may comprise various forms of an ink jet printer.

Figure 3:
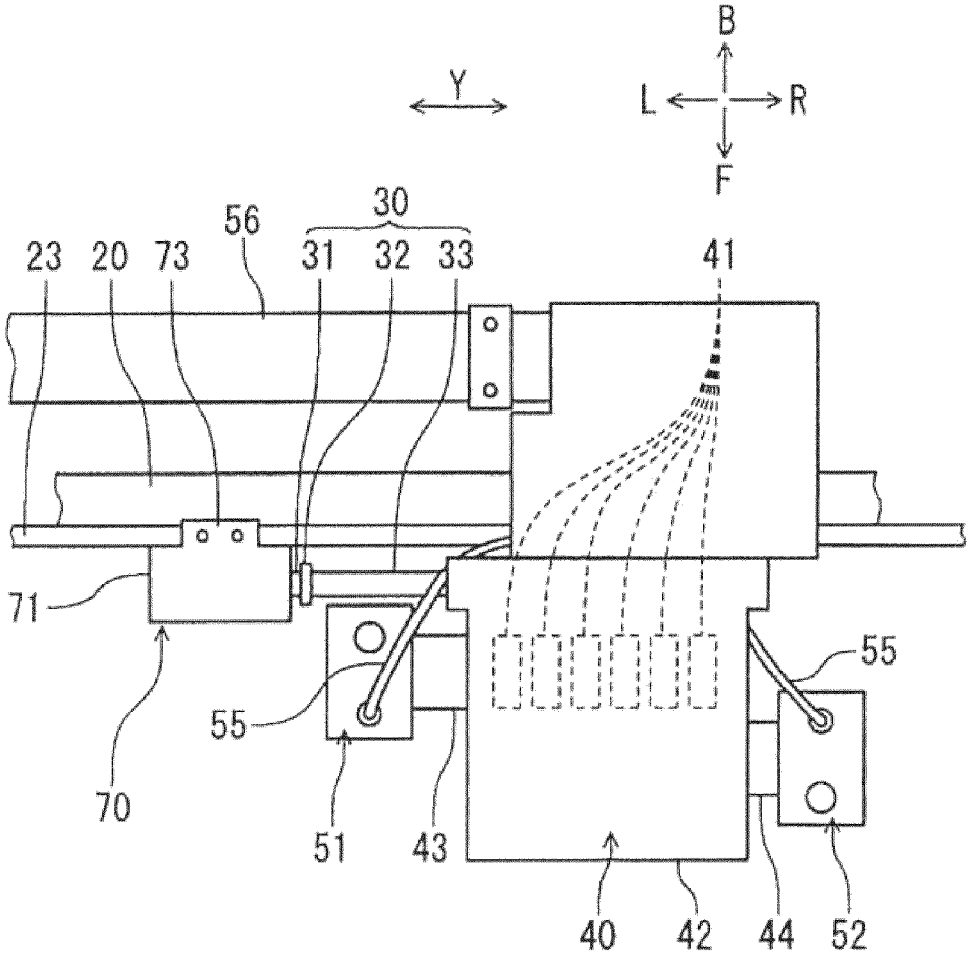
FIG. 3 is a plan view of a cutting head, an ink head and an ultraviolet light irradiation device according to an embodiment of the present invention.
Figure 4:
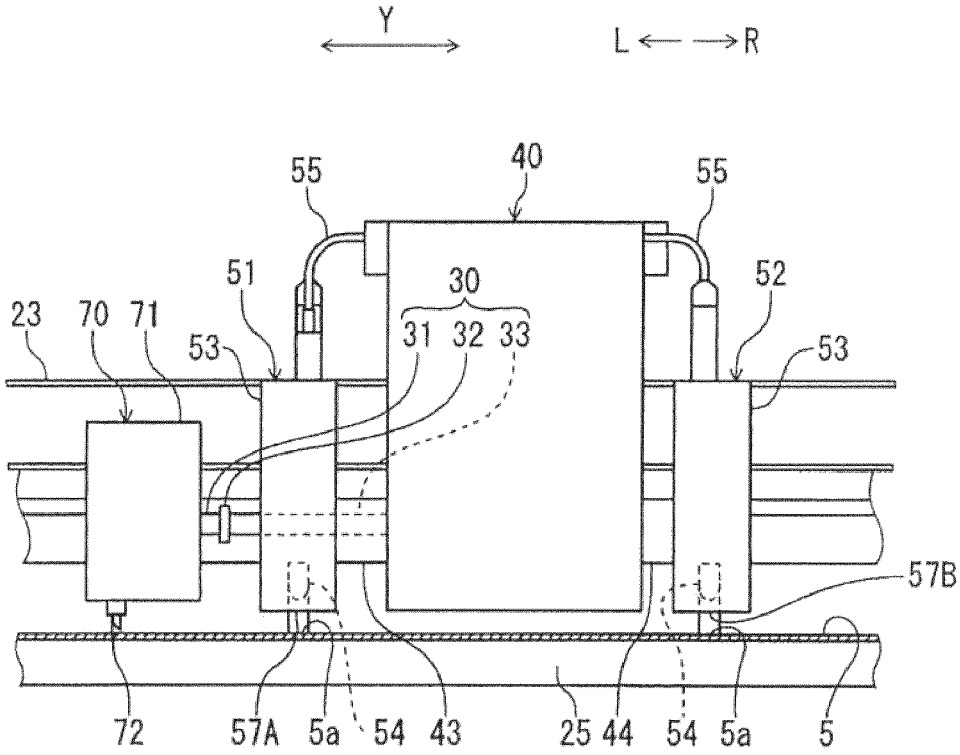
FIG. 4 is a front view of the cutting head, the ink head and the ultraviolet light irradiation device illustrated in FIG. 3.

The ink jet printer 1 may be equipped with an ink head 40 and a cutting head 70 (see FIG. 3 and FIG. 4). The ink jet printer 1 is capable of performing printing and cut operations with respect to a sheet of recording paper 5.

It is noted that a mark Y shown in FIG. 1 indicates a first scanning direction, and a mark X indicates and second scanning direction. More specifically, the second scanning direction is a direction perpendicular to the first scanning direction. The ink head 40 and the cutting head 70 move with respect to the first scanning direction and the recording paper 5 moves with respect to the second scanning direction 5. Also, as shown in FIG. 1, a sign F indicates the front, a sign B indicates the rear, a sign L indicates the left and a sign R indicates the right.

The ink jet printer 1 is provided with a main body 10 having a casing 10A that extends in the first scanning direction, and legs 11 that support the main body 10. An operation panel 12 is provided on a side of the main body 10. Although not illustrated, the operation panel 12 may be equipped with a display section that displays operation status, a cursor key for designating the positions of the ink head 40 and the cutting head 70, a region setting key for designating a region within a specified portion of the recording paper 5 for printing or cutting based on an image data signal, and an operation start key for starting printing or cutting from the region designated by the region setting key.

A front cover 15, which may be freely opened and closed, is mounted on an upper portion of the main body 10. A discharge port 13 for discharging the recording paper 5 is formed on the lower side of the main body 10. A guide 14 is provided the front of the main body and below the discharge port 13. The guide 14 guides the recording paper 5 discharged from the discharge port 13 in a forwardly diagonal downward direction.

It is noted that, in the current embodiment, the left-right direction refers to the first scanning direction, and the front-rear direction refers to the second scanning direction. Additionally, the front-rear, left-right, and up-down directions correspond to directions as seen from a position of an operator (not shown) facing the front of the discharge port 13, respectively. It is noted, however, that the front-rear, left-right and up-down directions as seen from a position of an operator are relative, and change depending on the positional relation between the operator and the ink jet printer 1. For this reason, as stated above, the left-right direction refers to the first scanning direction and the front-rear direction refers to the second scanning direction.

Figure 2:
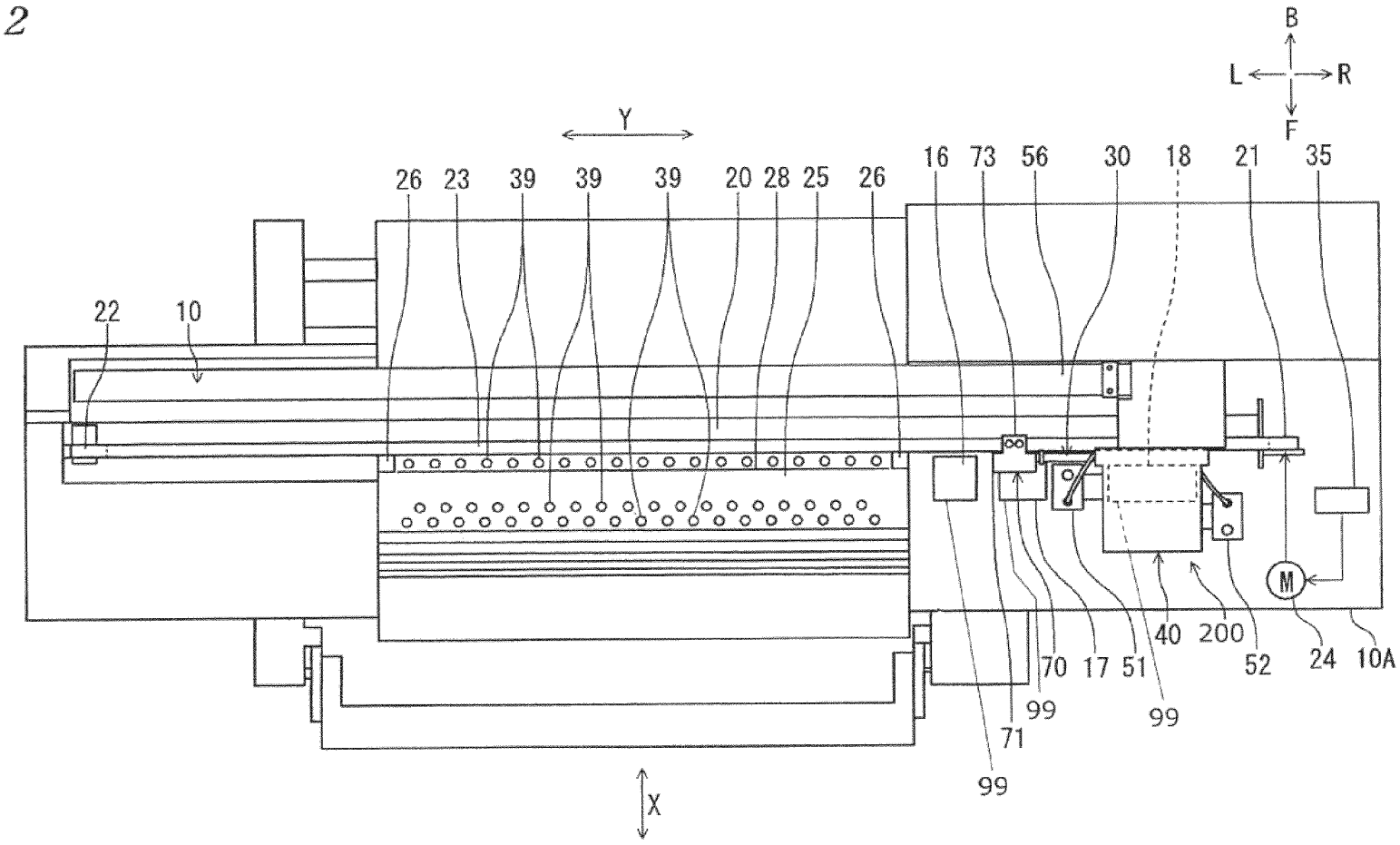
FIG. 2 is a plan view showing the internal structure of the ink jet printer illustrated in FIG. 1.

The internal structure of the main body 10 shall be described with respect to FIG. 2. As shown in FIG. 2, a guide rail 20 extending in the left-right direction is provided inside the main body 10. A platen 25 is disposed in a central area and in front of the guide rail 20.

The platen 25 supports the recording paper 5 when the ink head 40 is printing and when the cutting head 70 is cutting. Specifically, printing and cutting of the recording paper 5 are conducted on the platen 25. Multiple holes 39 are formed in the platen 25.

Although not shown, the ink jet printer 1 is equipped with a suction device such as a pump for providing suction via the holes 39. The recording paper 5 is attracted to the platen 25 as the suction device sucks air through the holes 39.

A first pulley 21 is provided adjacent to the right end section of the guide rail 20, and a second pulley 22 is provided adjacent to the left end section of the guide rail 20. A belt 23 is wound around the first pulley 21 and the second pulley 22.

A motor 24 is coupled to the first pulley 21. The belt 23 is driven between the first pulley 21 and the second pulley 22 when the motor 24 drives the first pulley 21. A control device 35 is connected to the motor 24. The motor 24 is a motor that can be freely rotated in forward and reverse directions. The control device 35 controls the motor 24, thereby controlling movements of a carriage 73.

It is noted that, in accordance with the present embodiment, the motor 24 drives the first pulley 21. However, the motor 24 may drive the second pulley 22.

As shown in FIG. 2, a pair of upper and lower rollers 26 are provided at the left end section and the right end section of the platen 25 for feeding the recording paper 5 in the second scanning direction X (it is noted that FIG. 2 only illustrates the upper rollers 26). Among the pair of upper and lower rollers 26, one of the rollers is a driving roller that rotates itself, and the other roller is a pinching roller for pinching the recording paper 5 with the driving roller.

The operation of the driving rollers is controlled by the control device 35. The rollers 26 form a transfer mechanism that transfers the recording paper 5 in the second scanning direction. Additionally, in accordance with another embodiment, the set positions of the pair of upper and lower rollers 26 may not be limited to the left end section and the right end section of the platen 25.

The cutting head 70 will be described with respect to FIGS. 3 and 4. As shown in FIG. 4, the cutting head 70 is equipped with a cutter 72, a holder 71 that retains the cutter 72, and the carriage 73 (see FIG. 3) provided on the holder 71. The holder 71 engages with the guide rail 20, and is guided by the guide rail 20 along the first scanning direction.

As shown in FIG. 3, the carriage 73 is affixed to the belt 23. The carriage 73 is transferred in the left and right directions as the belt 23 is driven. The carriage 73 moves to the left as the motor 24 rotates in one direction and the carriage 73 moves to the right as the motor 24 rotates a second direction. In accordance with the present embodiment, the carriage 73 is built in the cutting head 70. However, the carriage 73 may be formed as one piece with the holder 71, or may be formed independently.

It should be noted, however, that the carriage 73 is not limited to the carriage 73 that is built in the cutting head 70. The carriage 73 may be provided independently of the cutting head 70. More specifically, the carriage 73 may be coupled to the cutting head 70 in a manner such that the carriage 73 may be attachable to the cutting head 70. Furthermore, the carriage 73 may be built in the ink head 40. Alternatively, the carriage 73 may be provided independently of both of the cutting head 70 and the ink head 40.

The cutting head 70 is a head for cutting the recording paper 5. During a cut operation, the cutter 72 is lowered and pushed against the recording paper 5. Then, the cutting head 70 moves in the first scanning direction in response to a movement of the carriage 73. Additionally, the recording paper 5 is transferred by the rollers 26 in the second scanning direction. Thus, an arbitrary portion of the recording paper 5 can be cut out as a result or the movement of the cutter 72 and the recording paper 5.

It is noted that the cutting operation on the recording paper 5 by the cutter 72 not only includes cutting the entire recording paper 5, but also includes cutting a portion of the recording paper 5. In other words, cutting the recording paper 5 by the cutter 72 is not limited to cutting by completely penetrating the cutting paper 5 by the cutter 72.

For example, the recording paper 5 may comprise a plurality of layers, and the cutter 72 is moved with respect to the recording paper 5 and may only penetrate an upper portion of the layers of the recording paper 5. Accordingly, the cutter 72 only cuts a portion of the recording paper 5.

A groove extending in the left-right direction is formed in the platen 25, and a sliding member (see FIG. 2) is fitted therein. The sliding member 28 assists in making the cutter 72 more slidable against the recording paper 5.

The cutter 72 is assisted in sliding when the tip portion of the cutter 72 that penetrates the recording paper 5 in the up-down direction is supported on the sliding member 28. The sliding member 28 is formed from a material having a higher lubricity to the cutter 72 than to the platen 25. In the present embodiment, the sliding member 28 may be formed from Teflon. However, the material for the sliding member 28 is not particularly limited to Teflon, and may be formed from a similar material.

Figure 5:
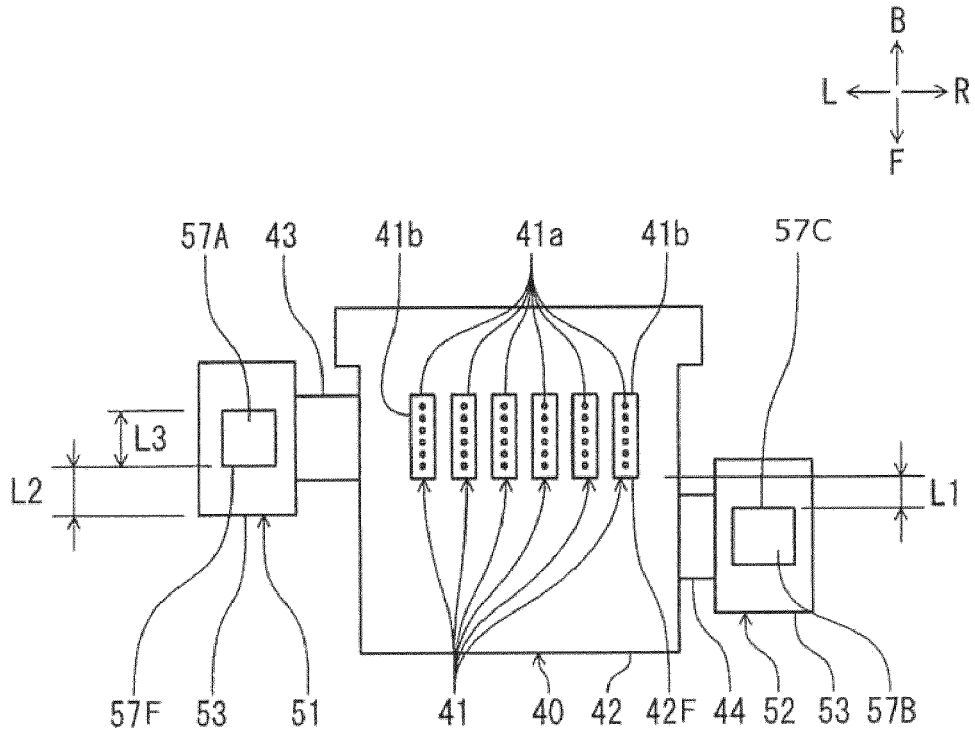
FIG. 5 is a bottom view of the ink head and the ultraviolet light irradiation device illustrated in FIG. 3.

As shown in FIG. 5, an ink head 40 has a plurality of print heads 41 for ejecting ink droplets, each print head having a plurality of nozzles 41*a* for ejecting ink. The ink head 40 also comprises a print head carriage 42 that supports the plurality of print heads 41. The ink head 40 ejects ink toward the recording paper 5.

The print head carriage 42 engages with the guide rail 20 such that the print head carriage 42 is freely movable in the left-right direction. FIG. 5 shows an enlarged view of the nozzles 41*a*, and for the sake of convenience also shows a limited number of nozzles 41*a*. According to current embodiment, the size of the nozzles 41*a* is much smaller than that illustrated in FIG. 5, and the nozzles 41*a* are formed in a greater number in the print head 41.

Figure 6:
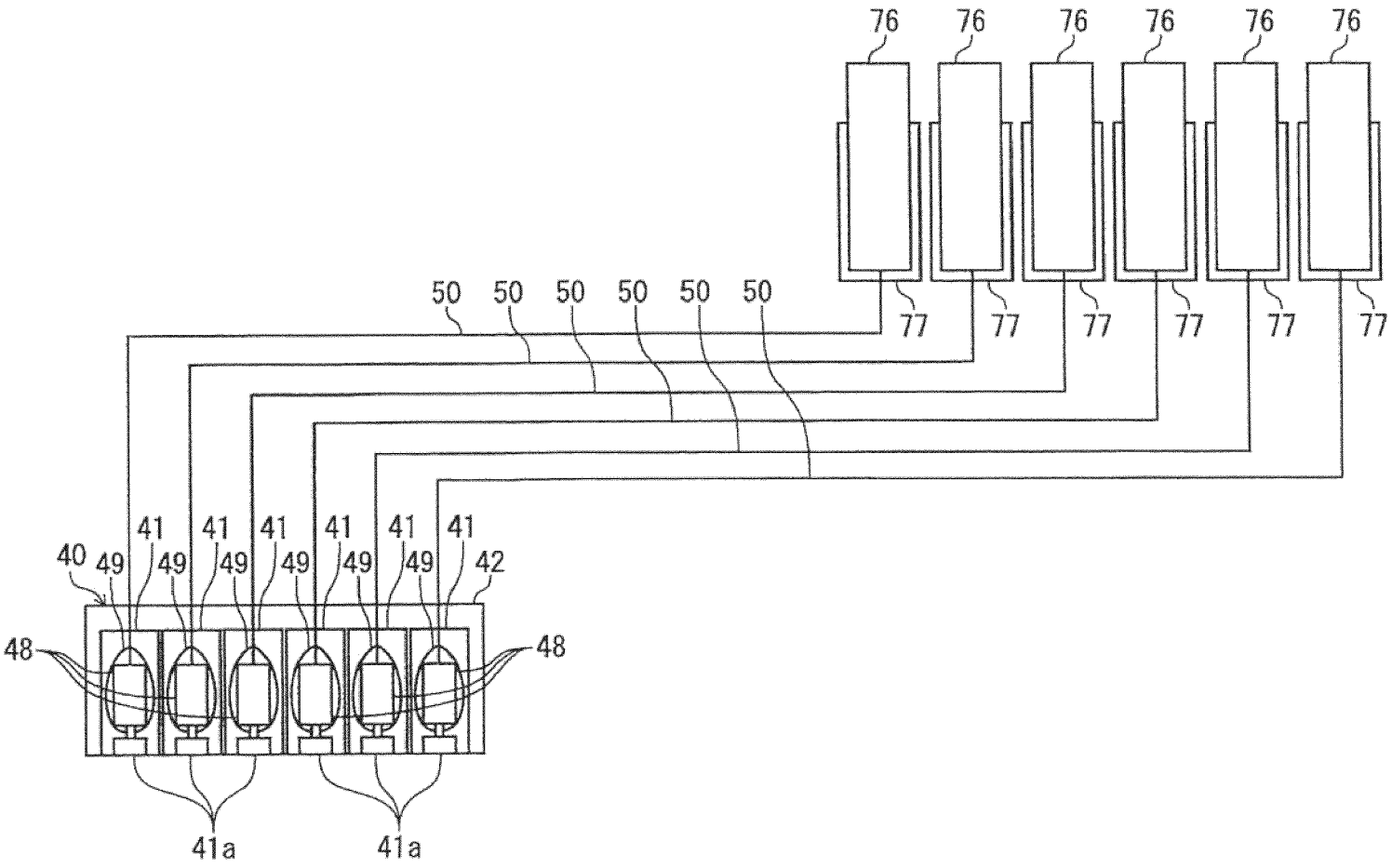
FIG. 6 is a view of the structure of an ink supply system according to an embodiment of the present invention.

FIG. 6 illustrates an ink supply system according to an embodiment of the present invention. Ink cartridges filled with ink are mounted at the rear of the main body 10 (not shown). Ink cartridges 76 are inserted in cartridge holders 77. The print heads 41 include dumpers 48 communicating with the nozzles 41*a*.

The dumpers 48 are formed from containers that can store ink and are provided for dumping pressure changes of ink within the nozzles 41*a*. Additionally, the dumpers 48 are covered by aluminum bags 49, thereby, making it difficult for ultraviolet light to enter the dampers 48. For this reason, solidification and adherence of ultraviolet light curable ink within the dampers 48 may be prevented.

Ink packs containing ultraviolet light curable ink are stored inside the ink cartridges 76 (not shown). Each of the ink cartridges 76 is structured in a manner such that the ink pack can be replaced. Each of the ink packs can be used together with an aluminum bag that is provided with a zipper.

Prior to being stored in the ink cartridge 76 and after being retrieved from the ink cartridge 76, the ink pack can be handled in a state in which it is contained in the bag described above. This structure can prevent the ink inside the ink pack from being irradiated with ultraviolet light and thereby preventing the deterioration of the ink.

Additionally, during times of continuous operation, such as during a large print job, ink packs with low ink levels may be replaced with new ink packs. In such cases, the old ink packs may be placed and stored in the aluminum bags with zippers, whereby the old ink packs can be reused at a later time.

The dampers 48 are connected to the ink cartridges 76 via tubes 50 disposed within a cableveyor 56 (see FIG. 2). Ink is supplied to the print heads 41 from the ink cartridges 76.

Figure 7:
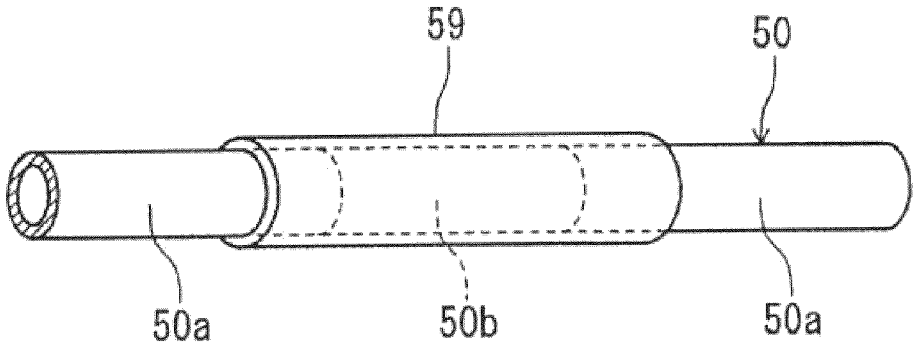
FIG. 7 is a perspective view of a tube according to an embodiment of the present invention.

As shown in FIG. 7, each of the tubes 50 has an opaque section 50*a* and a transparent section 50*b*. The transparent section 50*b* allows for visual confirmation as to whether the ink is flowing within the tube 50. The transparent section 50*b* is covered by a material that does not pass ultraviolet light, such as, for example, an aluminum member 59. Therefore, curing of the ink inside the transparent section 50*b* can be prevented.

The ink head 40 ejects ultraviolet light curable ink. More specifically, at least one of the print heads 41 ejects ultraviolet light curable ink. The ink jet printer 1 is equipped with a first ultraviolet light irradiation device 51 and a second ultraviolet light irradiation device 52. (See FIG. 5).

The first ultraviolet light irradiation device 51 is mounted to the left side of the print head carriage 42 via a connection member 43. The first ultraviolet light irradiation device 51 is located between the ink head 40 and the cutting head 70. The second ultraviolet light irradiation device 52 is mounted to the right side of the print head carriage 42 via a connection member 44.

The first ultraviolet light irradiation device 51 and the second ultraviolet light irradiation device 52 are disposed with their centers located in the front-rear direction. The first ultraviolet light irradiation device 51 is disposed in a more rear position in comparison to the second ultraviolet light irradiation device 52. The control device 35 controls the irradiation operations of both of the first and second ultraviolet light irradiation devices 51 and 52.

As shown in FIG. 4, the first ultraviolet light irradiation device 51 is equipped with a case 53, a light source 54 provided within the case 53, and a cable 55 for supplying electricity to the light source 54. The light source 54 is formed from an ultraviolet light emitting diode. The cable 55 is connected to a power supply (not illustrated) via the cableveyor 56 (see FIG. 2).

As shown in FIG. 5, irradiation sections 57A and 57B that transmit ultraviolet light irradiated from the light sources 54 are formed on the underside of the cases 53 of the first and second ultraviolet light irradiation devices 51 and 52, respectively. The irradiation sections 57A and 57B are sections for irradiating ultraviolet light to the recording paper 5. In accordance with the present embodiment, the irradiation sections 57A and 57B must facilitate transmittal of ultraviolet light and are not limited to a specific structure.

The irradiation sections 57A and 57B may be openings formed in the cases 53, or may be formed from any material that transmits ultraviolet light. Additionally, the light sources 54 may form the irradiation sections 57A and 57B. In accordance with the present embodiment, the irradiation sections 57A and 57B are formed from plates that transmit ultraviolet light.

As shown in FIG. 4, the regions of the recording paper 5 located immediately below the irradiation sections 57A and 57B are irradiation regions 5*a*. The irradiation regions 5*a* are regions at which the irradiation sections 57A and 57B are projected downward.

The ink jet printer 1 transfers the recording paper 5 in the front-rear direction during a printing operation by the ink head 40. For example, each time the ink head 40 moves from one side to the other side in the first scanning direction the recording paper 5 is transferred to the front by a predetermined feed amount. The feed amount of the recording paper 5 is not particularly limited, but is set at an amount greater than a predetermined minimum feed amount.

It is noted here that, when the minimum feed amount is M1, the length L1 (FIG. 5) between a rear end 57C of the irradiation section 57B and a front end 42F of the nozzle surface 41*b* has a relation of L1 being greater than or equal to M1. More specifically, the length L1 in the front-rear direction is greater than the minimum feed amount M1.

The structure of the second ultraviolet light irradiation device 52 is similar to the structure of the first ultraviolet light irradiation device 51. Accordingly, detailed descriptions of the second ultraviolet light irradiation device 52 are omitted.

The second ultraviolet light irradiation device 52 is disposed in a more forward position with respect to the first ultraviolet light irradiation device 51. The first ultraviolet light irradiation device 51 may immediately cure ink deposited on the recording paper 5 which has been ejected from the ink head 40. In contrast, the second ultraviolet light irradiation device 52 does not immediately cure ink deposited on the recording paper 5, but cures the ink after a predetermined time has elapsed.

Ink deposited on the recording paper 5 moves forward with the forward feed movement of the recording paper 5 by the rollers 26 (see FIG. 2). A certain period of time elapses while the ink at a position immediately below the nozzle 41*a* moves to a position immediately below the irradiation section 57B of the second ultraviolet light irradiation device 52. The ink has a certain degree of viscosity, and thus forms a bulging surface on the recording paper 5 on a microscopic scale immediately after the ink is deposited on the recording paper 5.

However, after a certain period of time, the ink spreads on the recording paper 5 and becomes more flat. Therefore, the surface of the ink on the recording paper 5 may be smoother when the ink is cured after a certain period of time. Thus, the finish of the print may be adjusted.

As shown in FIG. 5, the length L2 between a rear end 57C of the irradiation section 57B and a front end 57F of the irradiation section 57A is greater than zero but less than the length L3 of the irradiation section 57A. In other words, the irradiation section 57A and the irradiation section 57B are separated at a relatively large distance from each other in the front-rear direction.

It is noted that the ultraviolet light irradiation devices 51 and 52 are not limited to ultraviolet light emitting diodes. Other irradiation devices, such as, halogen lamps may also be used as the ultraviolet light irradiation devices 51 and 52.

As shown in FIG. 3, a coupling mechanism 30 is provided at the rear of the first ultraviolet light irradiation device 51 for detachably coupling the cutting head 70 and the ink head 40. The coupling mechanism 30 is equipped with a coupling member 31 extending from the holder 71 to the right, a magnet 32 provided at the right end of the coupling member 31, and a coupling member 33 extending from the rear left side of the print head carriage 42 to the left. The left end section of the coupling member 33 is formed from a magnetic material, such as iron.

As the magnet 32 comes in contact with the coupling member 33, the coupling member 33 is attracted by the magnet 32. As a result, the cutting head 70 and the ink head 40 are coupled to each other via the coupling mechanism 30. The cutting head 70 moves in the first scanning direction according to movements of the belt 23.

Therefore, as the cutting head 70 and the ink head 40 are coupled to each other, the ink head 40 moves in the first scanning direction together with the cutting head 70. At the time of printing, the cutting head 70 and the ink head 40 are coupled to each other via the coupling mechanism 30, and the ink head 40 is transferred in the first scanning direction by the carriage 73.

In the present embodiment, the coupling mechanism 30 is equipped with the magnet 32, and uses the magnetic force. However, the coupling mechanism 30 is not limited to the one equipped with the magnet 32, and may be sufficient as long as it can detachably couple the cutting head 70 and the ink head 40.

As shown in FIG. 2, the ink jet printer 1 is equipped with an ink head aiding system 99 for maintaining the performance of the ink head 40. The ink head aiding system 99 is disposed to the right of the platen 25. The ink head aiding system 99 includes, a flushing device 16, a wiper device 17 and a capping device 18. However, the ink head aiding system 99 may be equipped with other elements. Also, the flushing device 16 or the wiper device 17 may be omitted from the ink head aiding system 99.

In accordance with the present embodiment, the flushing device 16, the wiper device 17, and the capping device 18 are disposed in the respective order from the left side to the right side. However, it should be noted that the arrangement order of the constituting elements of the ink head aiding system 99 is not limited to the order described above.

The ink jet printer 1 may discharge ink from the nozzles 41*a*, irrespective of printing on the recording paper 5, in order to prevent the nozzles 41*a* of the ink head 40 from clogging. The flushing device 16 is provided for collecting ink discharged from the ink head 40 during an ink discharge for preventing the clogging of the nozzles 41*a*.

Figure 8:
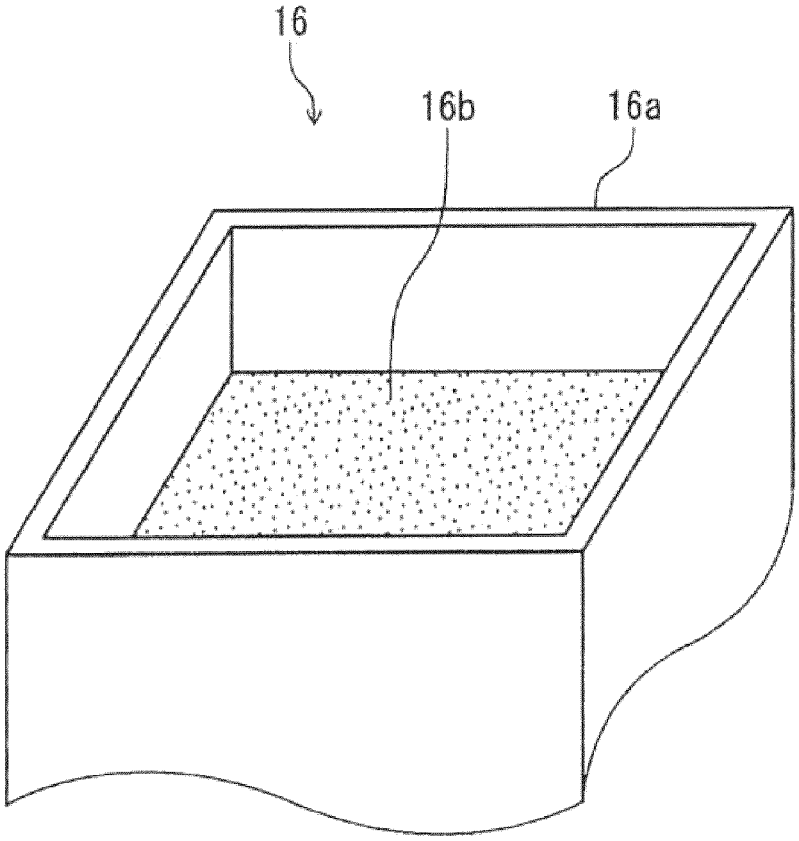
FIG. 8 is a perspective view of a flushing device according to an embodiment of the present invention.

As shown in FIG. 8, the flushing device 16 is equipped with a container 16*a* that opens upwardly, and an absorbent 16*b* stored in the container 16*a*. The absorbent 16*b* absorbs ink discharged.

When discharging ink in order to prevent clogging of the nozzles 41*a*, the ink head 40 is transferred to a location above the container 16*a*, and ink is discharged toward the container 16*a*. In accordance with the present embodiment, the absorbent 16*b* is a sponge. However, the material of the absorbent 16*b* is not particularly limited to a sponge. It is also possible to omit the absorbent 16*b*.

Figure 9:
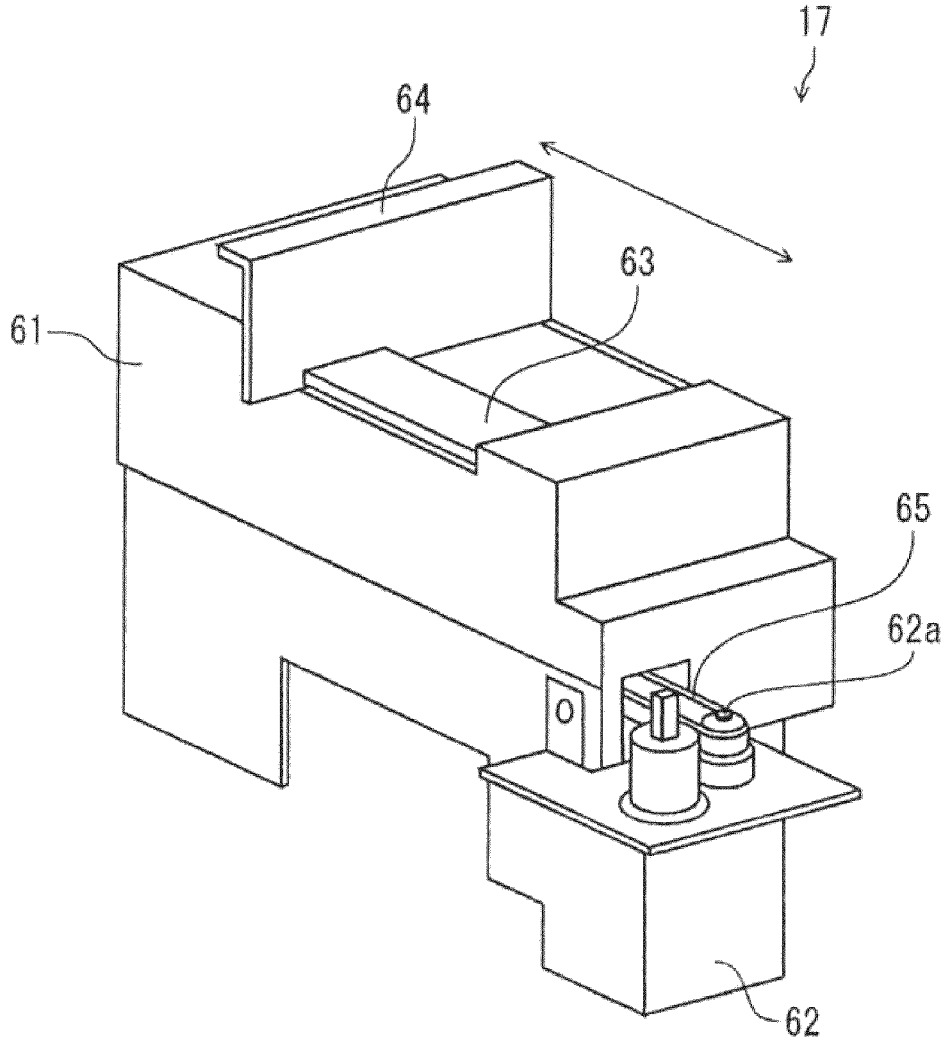
FIG. 9 is a perspective view of a wiper device according to an embodiment of the present invention.

The wiper device 17 wipes the nozzle surface 41*b* to clean the nozzle surface 41*b* of the ink head 40. As shown in FIG. 9, the wiper device 17 is equipped with a case 61, a guide rail 63 supported by the case 61 and a wiper 64 that is freely movable in the front-rear direction along the guide rail 63. Also, the wiper device 17 is equipped with a motor 62 that is mounted on the case 61 and a belt 65 that is wound around a rotation shaft 62*a* of the motor 62. The wiper 64 is coupled to the belt 65, though its illustration is omitted.

As the motor 62 is driven, the wiper 64 moves in the front-rear direction along the guide rail 63. To clear up the nozzle surface 41*b*, the ink head 40 is transferred to a location above the wiper device 17. Then, the wiper 64 moves in the front-rear direction in a state in which the wiper 64 is in contact with the nozzle surface 41*b*. By this, the nozzle surface 41*b* is wiped by the wiper 64, whereby unnecessary ink and the like adhered to the nozzle surface 41*b* is removed.

Figure 10A:
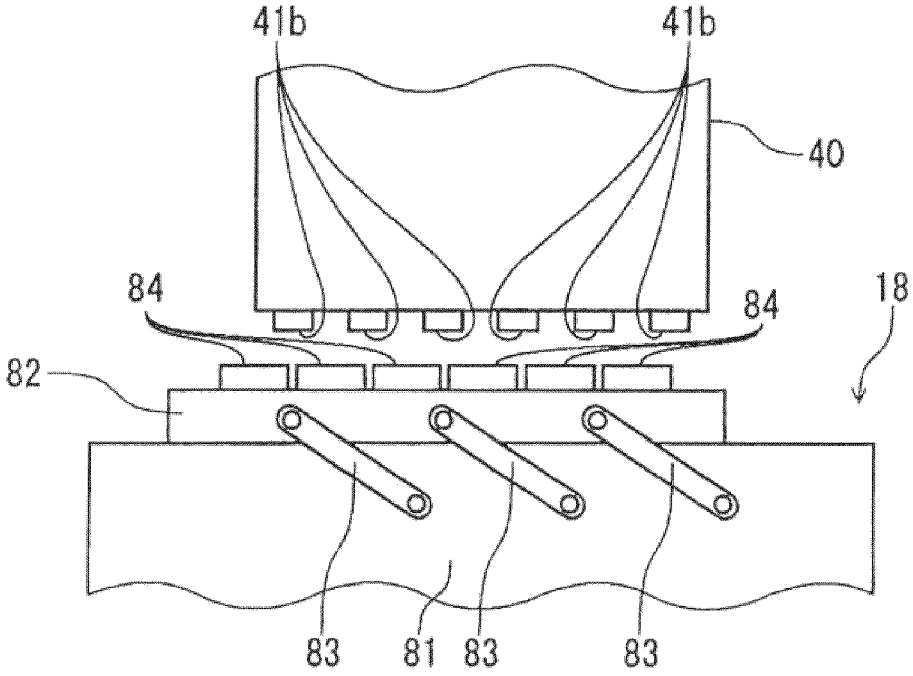
FIGS. 10A and 10B are front views of the ink head and a capping device according to an embodiment of the present invention.

The capping device 18 is provided for surrounding the nozzle surface 41*b* to prevent ink within the nozzle 41*a* from drying when printing is not performed. As shown in FIG. 10A, the capping device 18 is equipped with a base 81 and a mobile stage 82 attached to the base 81 through link bars 83. A plurality of caps 84 are provided on the mobile stage 82.

Figure 11:
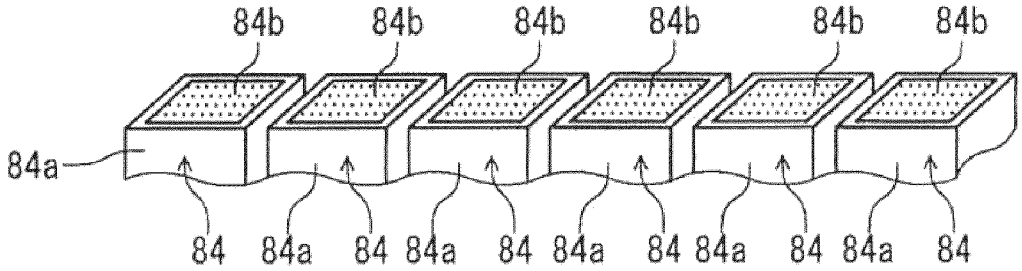
FIG. 11 is a perspective view of a cap of the capping device illustrated in FIGS. 10A and 10B.

As shown in FIG. 11, each of the caps 84 is equipped with an upwardly opening case 84*a* and an absorbent 84*b* provided inside the case 84*a*. The absorbent 84*b* is not particularly limited to any material, but the absorbent 84*b* in the present embodiment may be a sponge.

Figure 10B:
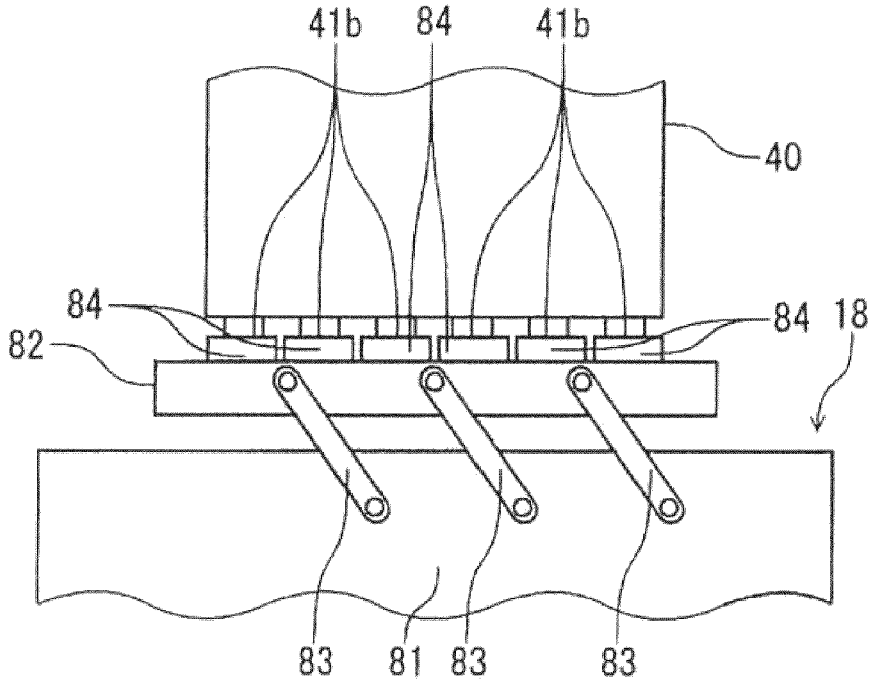

When printing is not performed, the ink head 40 is transferred to a position above the capping device 18. Then, the mobile stage 82 is moved upward by a driving device. As a result, as shown in FIG. 10B, the nozzle surface 41*b* of the ink head 40 is surrounded by the cap 84.

It is noted that, although not illustrated, a rubber seal is provided at the cap 84. When the nozzle surface 41*b* is surrounded by the cap 84, the air is prevented by the rubber seal from entering the cap 84. Thus the ink within the ink head 40 is prevented from drying.

Figure 12:
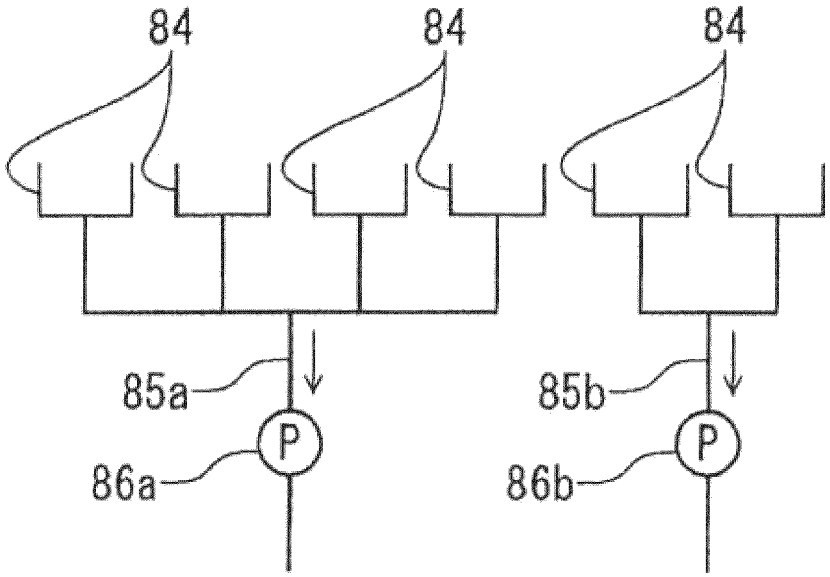
FIG. 12 is a schematic structural view of a suction device provided on the capping device illustrated in FIGS. 10A and 10B.

As shown in FIG. 12, among the plurality of caps 84, four of the caps 84 are connected to a first pump 86*a* through a first flow path 85*a*, and the remaining two caps 84 are connected to a second pump 86*b* through a second flow path 85*b*. The pumps 86*a* and 86*b* are provided for applying suction to ink within the nozzles 41*a* of the ink head 40.

The number of caps is not limited to the number of caps illustrated in FIG. 12. A greater number of the caps 84 are connected to the first pump 86*a*, compared to the second pump 86*b*. Thus the suction rate of the first pump 86*a* is set to be greater than the suction rate of the second pump 86*b*.

As shown in FIG. 2, a position above the capping device 18 is a home position 200 of the ink head 40. When the power supply to the ink jet printer 1 is turned OFF, before a printing operation starts, and when the cutting head 70 performs a cutting-out operation, the ink head 40 waits at the home position 200.

Figure 13:
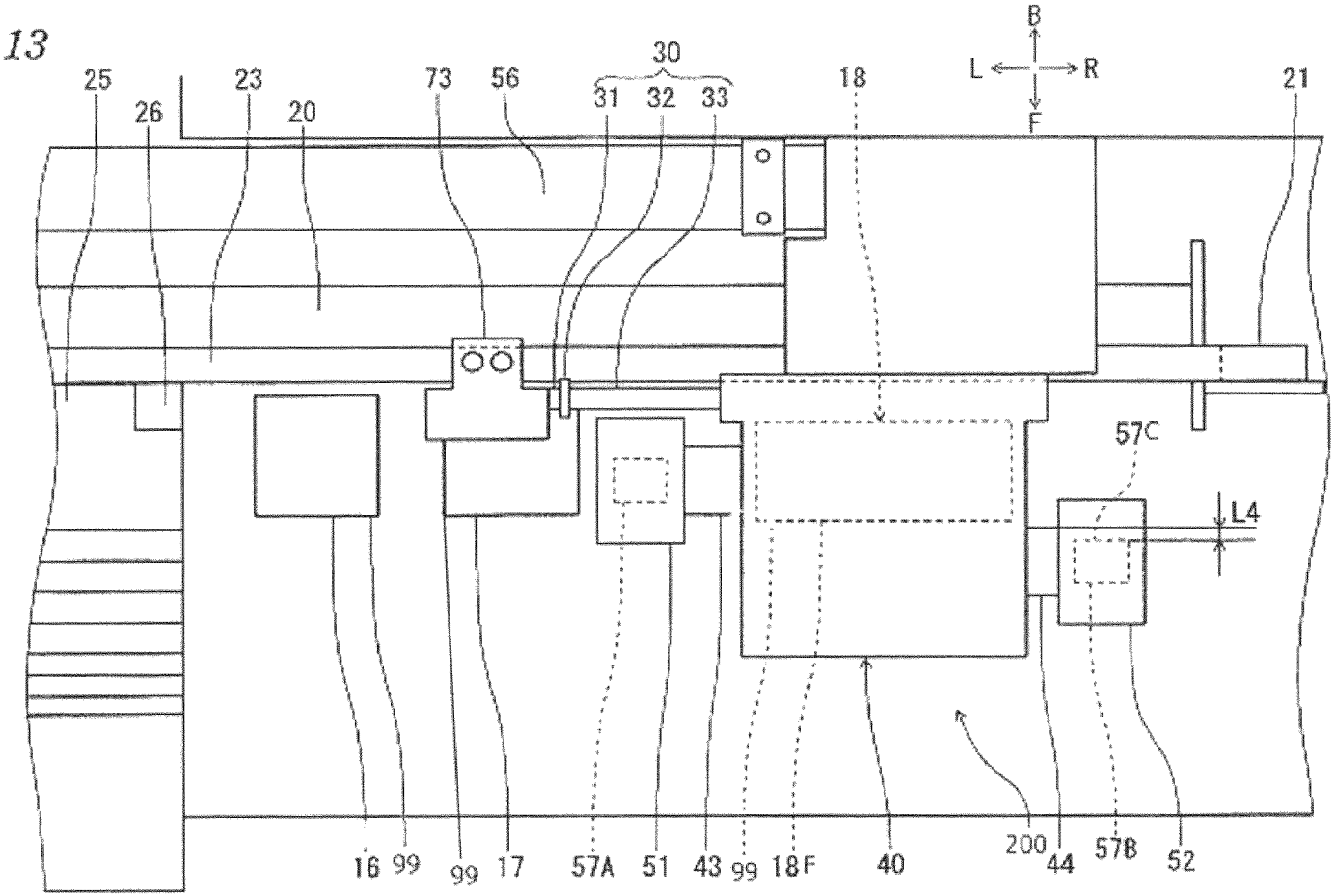
FIG. 13 is a plan view of an ink head and an ink head aiding system according to an embodiment of the present invention.

As shown in FIG. 13, at least a portion of the irradiation section 57B of the second ultraviolet light irradiation device 52 is located at the front of at least one of the elements of the ink head aiding system 99. In FIG. 13, a mark 57C represents a rear end of the irradiation section 57B, and a mark 18F represents a front end of the capping device 18. The position of the rear end 57C and the position of the front end 18*f* in the front-rear direction are separated by a distance L4.

In the present embodiment, the irradiation section 57B in its entirety is located at the front of the capping device 18. Also, the irradiation section 57B in its entirety is located at the front of the flushing device 16. Furthermore, the irradiation section 57B in its entirety is located at the front of the wiper device 17.

Figure 14A:
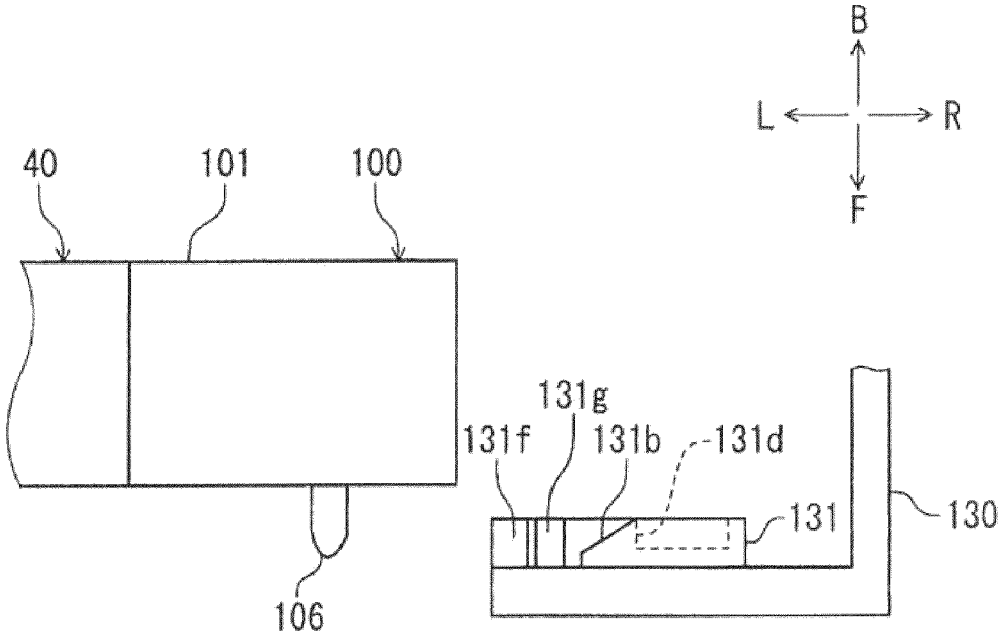
FIGS. 14A and 14B are plan views of a lock mechanism according to an embodiment of the present invention.
Figure 14B:
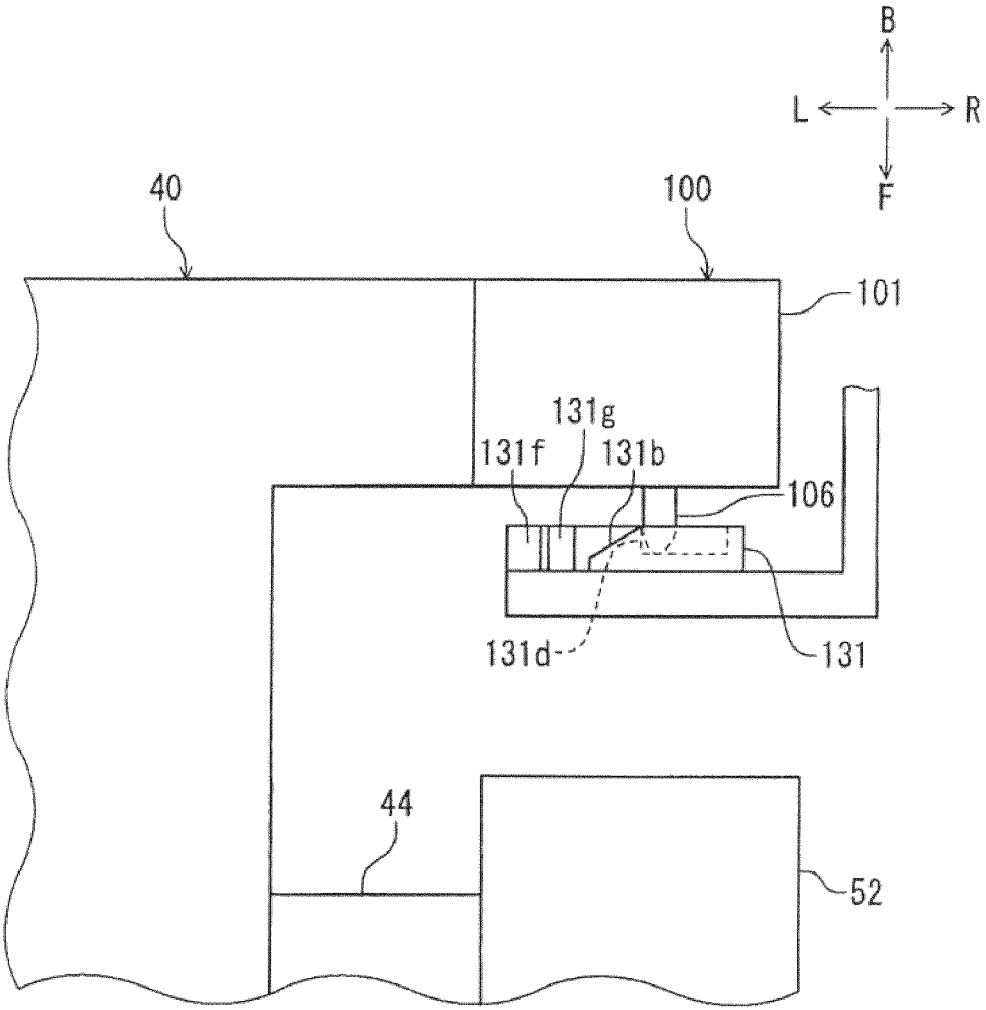

As shown in FIGS. 14A and 14B, the ink jet printer 1 is equipped with a lock mechanism 100 that locks the ink head 40 at the home position 200. The lock mechanism 100 is disposed at the rear of the second ultraviolet light irradiation device 52. It is noted that illustration of the lock mechanism 100 is omitted in the figures except FIG. 14A and FIG. 14B.

Figure 15:
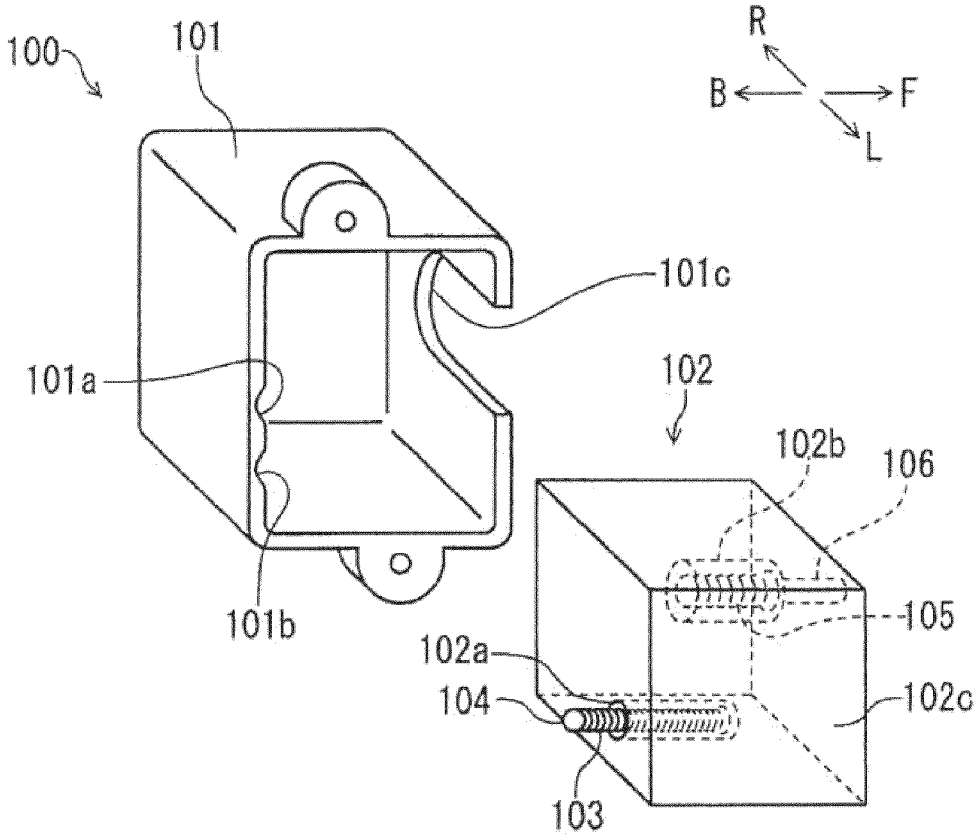
FIG. 15 is an exploded perspective view of the lock mechanism illustrated in FIGS. 14A and 14B.

As shown in FIG. 15, the lock mechanism 100 is equipped with a case 101 that may be attached to the right side of the ink head 40, and a slider 102 that is stored in the case 101. The slider 102 and the case 101 may be formed from a material such as resin. The slider 102 can move within the case 101 in the up-down direction.

Two side-by-side upper and lower grooves 101*a* and 101*b* are formed in a rear inner surface of the case 101. A cut-out groove 101*c* that recedes to the right is formed in a front side section of the case 101. A bore 102*a* is formed in a rear side section of a main body 102*c* of the slider 102, and a bore 102*b* is formed in a front side section of the main body 102*c*. A spring 103 is provided within the bore 102*a*, and a metal ball 104 is attached to the tip of the spring 103. The ball 104 protrudes from the bore 102*a*.

Figure 16:
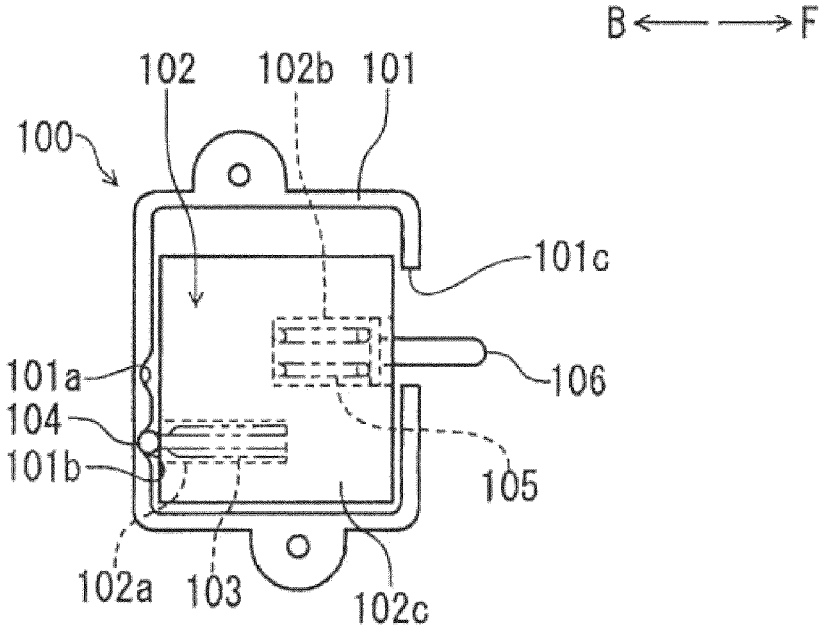
FIG. 16 is a side view of the internal structure of the lock mechanism illustrated in FIGS. 14A and 14B.

When the slider 102 is stored inside the case 101 (see FIG. 16), the ball 104 receives a force applied by the spring 103 in a direction in which it protrudes from the main body 102*c*. A spring 105 is provided inside the bore 102*b*, and a pin 106 is attached to the tip of the spring 105. The pin 106 receives a force applied by the spring 105 in a direction in which it protrudes from the main body 102*c*. As shown in FIG. 16, when the slider 102 is stored within the case 101, the pin 106 is positioned inside the cut-out groove 111*c*.

As described above, the slider 102 can move in the up-down direction within the case 101. For this reason, the pin 106 can freely move between an upper position where the ball 104 engages with the upper groove 101*a* and a lower position where the ball 104 engages with the lower groove 101*b*.

As shown in FIG. 14A, the main body 10 of the ink jet printer 1 is equipped with a member 130 that is incapable of moving with respect to the case 101. A block 131 is affixed to the member 130. The block 131 can be detachably coupled to the pin 106 of the lock mechanism 100.

Figure 17:
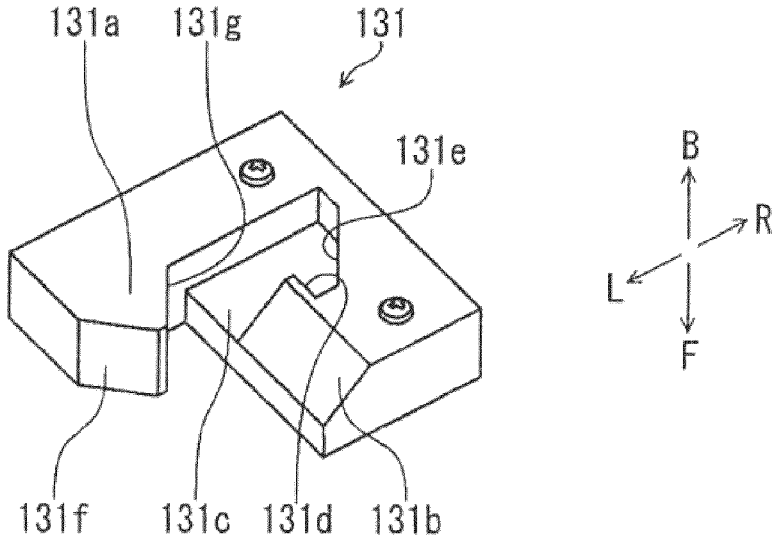
FIG. 17 is a perspective view of a block according to an embodiment of the present invention.

As shown in FIG. 17, the block 131 may be formed with a resin flat plate. A V-letter shaped segment 131*a* is formed on a left side section of the block 131. A sloped surface 131*b* for guiding the pin 106 is formed in a central section in the left-right direction of the block 131. A flat surface 131*c* that comes in contact with the tip of the pin 106 is formed at a level below the sloped surface 131*b* of the block 131. A stepped section 131*d* that engages with the pin 106 is formed at a level below and on the right side of the sloped surface 131*b* of the block 131. A sloped surface 131*e* that is sloped downwardly toward the right is formed on the right side of the stepped section 131*d* of the block 131. It is noted that a sloped surface 131*f* that is sloped upwardly toward the right is formed on the left side of the V-letter shaped segment 131*a*. A sloped surface 131*g* that is sloped downwardly toward the right is formed on the right side of the V-letter shaped segment 131*a*.

Next, locking actions of the ink head 40 by the lock mechanism 100 are described. As shown in FIG. 14A, the pin 106 normally protrudes from the case 101.

When the ink head 40 moves toward the home position 200, the pin 106 eventually comes in contact with the block 131. At this moment, when the pin 106 is at the lower side position, the pin 106 contacts the sloped surface 131*f*, and moves to the upper side position, guided by the sloped surface 131*f*. It is noted that, when the pin 106 is originally at the upper side position, the pin 106 does not come in contact with the sloped surface 131*f*.

As the ink head 40 moves further toward the home position 200, the pin 106 at the upper side position comes in contact with the sloped surface 131*b*. Then, the pin 106 moves up the sloped surface 131*b* toward the rear, while being pushed back.

When the pin 106 has completely moved up the sloped surface 131*b* the pin 106 moves to the rear of the stepped section 131*d*. In this instance, the pin 106 protrudes again to the front (see FIG. 14B). By this, the pin 106 engages with the stepped section 131*d*, and is set in a state where it cannot move to the left. As a result, the ink head 40 is locked at the home position 200.

Figure 18:
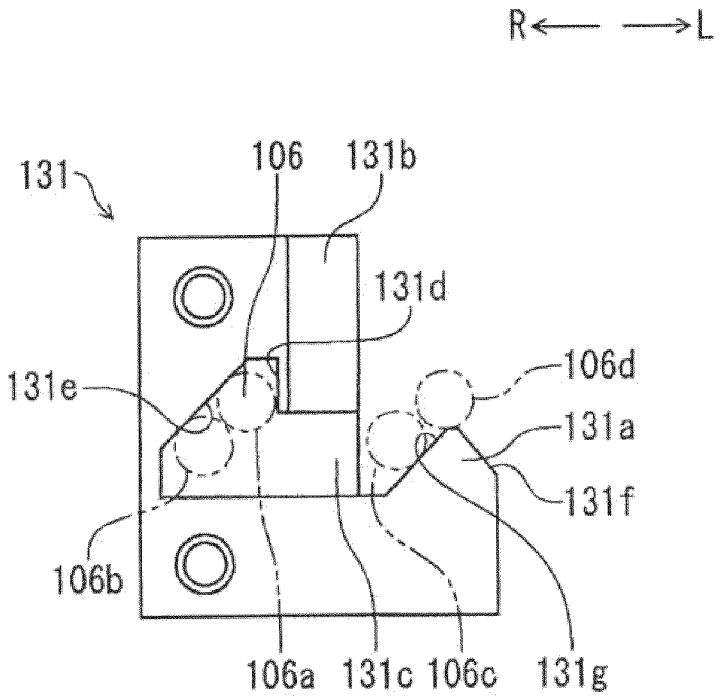
FIG. 18 is a rear side view of the block illustrated in FIG. 17.

The releasing action of the lock mechanism 100 will be described with reference to FIG. 18. FIG. 18 illustrates a rear view of the block 131. Therefore, the left side of FIG. 18 corresponds to the right side of the ink jet printer 1, and the right side of FIG. 18 corresponds to the left side of the ink jet printer 1.

The ink head 40 is moved once to the right in order to release the locked state of the ink head 40. Consequently, the pin 106 is guided by the sloped surface 131*e* and moves from the upper side position to the lower side position. In other words, the pin 106 moves from a position indicated by a mark 106*a* to a position indicated by a mark 106*b*.

After the ink head 40 moves to the right, the ink head 40 then moves to the left. Accordingly, the pin 106 moves from the position indicated by the mark 106*b* to a position indicated by a mark 106*c*. Upon contacting the sloped surface 131*g*, the pin 106 moves from the lower side position to the upper side position, as being guided by the sloped surface 131*g*. In other words, the pin 106 moves from the position indicated by the mark 106*c* to a position indicated by a mark 106*d*. Thus, the engagement of the pin 106 with the block 131 is released. The locked state of the ink head 40 is released as a result of the procedure described above.

The operations of the ink jet printer 1 will now be described. The ink jet printer 1 is capable of printing via the ink head 40, and cutting via the cutting head 70.

During a print operation, the ink head 40 ejects ink toward the recording paper 5 while reciprocally moving in the first scanning direction. The recording paper 5 is transferred by the rollers 26 in the second scanning direction.

For example, as the ink head 40 moves in the first scanning direction, the recording paper 5 is transferred forward by a predetermined length. Furthermore, the direction of the ink head 40 is reversed and moves in the first scanning direction and the recording paper 5 is again transferred forward by a predetermined length. Similar operations are then repeated.

Additionally, the ultraviolet light irradiation devices 51 and 52 are synchronized with the movements of the ink head 40 in the first scanning direction. By this, ultraviolet light is irradiated on the ink discharged on the recording paper 5. Then, the ink on the recording paper 5 is cured, and fixed on the recording paper 5. A two-dimensional image is formed on the recording paper 5 as a result of the movement of the recording paper 5, the ink head 40, and the ultraviolet light irradiation devices 51 and 52.

The transfer direction of the recording paper 5 not limited to the forward direction. After completing printing on a predetermined region of the recording paper 5, the recording paper 5 may be moved backward, and the predetermined region may be printed again. In other words, a plurality of inks may be superposed on the recording paper 5.

The control device 35 controls various components of the printer. For example, the control device 35 may control the movement of the ink head 40 in the first scanning direction, ejection of ink by the ink head 40, powering the ultraviolet light irradiation devices 51 and 52, and adjustment of the irradiation intensity.

Furthermore, the control device 35 positions the ink head 40 such that the irradiation section 57A of the first ultraviolet light irradiation device 51 is not positioned opposite one of the components of the ink head aiding system 99. For example, after the ink head 40 has moved to the right in a first scanning direction, the control device 35 may alter the movement of the ink head 40 such that the irradiation section 57A is not placed above the flushing device 16.

Additionally, the control device 35 may control the power of the first ultraviolet light irradiation device 51 during the movement of the ink head 40. For example, when the ink head 40 moves toward the home position 200, the ink head 40 moves to the right and the control device 35 controls the first ultraviolet light irradiation device 51 from an on state to an off state when the irradiation section 57A of the first ultraviolet light irradiation device 51 reaches a position opposite to one of the components of the ink head aiding system 99. Specifically, before the irradiation section 57A of the first ultraviolet light irradiation device 51 reaches a position which is opposite to one of the components of the ink head aiding system 99, the control device 35 turns OFF the first ultraviolet light irradiation device 51.

Accordingly, when the ink head 40 moves away from the home position 200, the ink head 40 moves to the left and the control device 35 controls the first ultraviolet light irradiation device 51 from the off state to the on state when the irradiation section 57A of the first ultraviolet light irradiation device 51 moves from a position which is opposite to one of the components of the ink head aiding system 99. Specifically, the control device 35 turns ON the first ultraviolet light irradiation device 51 after the irradiation section 57A of the first ultraviolet light irradiation device 51 moves away from a position which is opposite to one of the components of the ink head aiding system 99.

The position of the first ultraviolet light irradiation device 51 when the control device 35 turns on/off the first ultraviolet light irradiation device 51, and the position of the second ultraviolet light irradiation device 52 when the control device 35 turns on/off the second ultraviolet light irradiation device 52 are not limited and may vary according to various settings and requirements. Furthermore, the method for controlling the first and second ultraviolet light irradiation devices 51 and 52 by the control device 35 is not limited to the embodiment disclosed above.

In accordance with the present embodiment, the control device 35 performs a PWM (Pulse Width Modulation) control. Specifically, the control device 35 controls the irradiation intensity of the ultraviolet light irradiation devices 51 and 52 by changing the duty ratio of pulse waves to be supplied to the first and second ultraviolet light irradiation devices 51 and 52, and thereby changing the irradiation intensity. For example, if the feed amount for each feeding of the recording paper 5 is low, the control device 35 may lower the irradiation intensity of the ultraviolet light irradiation devices 51 and 52.

The cut operations by the cutting head 70 shall now be described. During a cut operation, the ink head 40 remains at the home position 200 in a separated state from the cutting head 70, as described above.

The cutting head 70 moves in the first scanning direction and the cutter 72 of the cutting head 70 (see FIG. 4) is lowered when the cutting head 70 moves to a predetermined position above the recording paper 5, thereby cutting the recording paper 5. While the cutter 7 maintains the position of cutting the recording paper 5, the cutting head 70 moves in the first scanning direction, and the recording paper 5 is transferred by the rollers 26 in the second scanning direction, thereby cutting the recording paper 5 in a predetermined shape.

As shown in FIG. 13, the irradiation section 57B of the second ultraviolet light irradiation device 52 is located in a position which is more forward in comparison to the irradiation section 57A of the first ultraviolet light irradiation device 51 in addition to the flushing device 16, the wiper device 17, and the capping device 18 of the ink head aiding system 99. Therefore, even if the light of the second ultraviolet light irradiation device 52 is unintentionally enabled above a component of the ink head aiding system 99, curing of ultraviolet light curable ink on the ink head aiding system 99 may be prevented due to the forward position of the ultraviolet light irradiation device 52.

Specifically, the current embodiment may prevent curing of ultraviolet light curable ink at the flushing device 16, the wiper device 17 and the capping device 18. Accordingly, preventing the curing of the ultraviolet light curable ink will prevent degradation of the performance of the ink head 40, and the functionality of the flushing device 16, the wiper device 17 and the capping device 18.

The location of the irradiation section 57B of the second ultraviolet light irradiation device 52 is not limited to the embodiment described above. Accordingly, an alternate embodiment may place only a portion of the irradiation section 57B of the second ultraviolet light irradiation device 52 at the front of the flushing device 16, the wiper device 17 and the capping device 18.

The alternate embodiment may still prevent curing of ultraviolet light curable ink on the flushing device 16, the wiper device 17 and the capping device 18. Furthermore, a portion or the entirety of the irradiation section 57B of the second ultraviolet light irradiation device 52 may be located in a more forward location in comparison to at least one of the flushing device 16, the wiper device 17 and the capping device 18. Thus, preventing the curing of the ultraviolet light curable ink will prevent degradation of the functionality of at least one of the flushing device 16, the wiper device 17 and the capping device 18.

As illustrated in FIG. 5, the irradiation section 57B is located in front of the nozzle surface 41*b*. The length L1 in the front-rear direction between the rear end 57C of the irradiation section 57B and the front end 42F of the nozzle surface 41*b* is greater than the minimum feed amount of the recording paper 5.

Therefore, a certain period of time may elapse from the time ink ejected from the ink head 40 contacts the recording paper 5 until the ink is cured by the second ultraviolet light irradiation device 52. Thus, the ink may be cured after the surface of the ink on the recording paper 5 has been smoothed. Accordingly, the degree of print finish may be suitably changed and a variety of print finishes may be acquired.

Similar to the process described above with respect to the irradiation section 57B of the second ultraviolet light irradiation device 52, the control device 35 controls the first ultraviolet light irradiation device 51 to change from an on state to an off state when the ink head 40 moves toward the home position 200, and before the irradiation section 57A of the first ultraviolet light irradiation device 51 reaches a position which is opposite to one of the components of the ink head aiding system 99. On the other hand, when the ink head 40 moves away from the home position 200, and after the irradiation section 57A of the first ultraviolet light irradiation device 51 moves away from the position opposite to one of the components of the ink head aiding system 99, the control device 35 controls the first ultraviolet light irradiation device 51 to change from an off state to an on state.

Specifically, the current embodiment may prevent curing of ultraviolet light curable ink to at least one of the components of the ink head aiding system 99. Accordingly, preventing the curing of the ultraviolet light curable ink will prevent degradation of the functionality of at least one of the components of the ink head aiding system 99.

Furthermore, during the printing operation, before the irradiation section 57A of the first ultraviolet light irradiation device 51 reaches a position opposite to the capping device 18, the control device 35 changes the direction of movement for the ink head 40 from the right direction to the left direction. In particular, in accordance with the present embodiment, before the irradiation section 57A of the first ultraviolet light irradiation device 51 reaches a position which is opposite to the flushing device 16, the control device 35 changes the moving direction of the ink head 40 from the right direction to the left direction.

Therefore, the current embodiment may prevent curing of ink on at least one of the components of the ink head aiding system 99. Accordingly, preventing the curing of the ultraviolet light curable ink will prevent degradation of the functionality of at least one of the components of the ink head aiding system 99.

The ink jet printer 1 is capable of curing ink deposited on the recording paper 5 by both of the first and second ultraviolet light irradiation devices 51 and 52. As shown in FIG. 5, the length L2 between the rear end 57C of the irradiation section 57B of the second ultraviolet light irradiation device 52 and the front end 57F of the irradiation section 57A of the first ultraviolet light irradiation device 51 is greater than zero but less than the length L3 of the irradiation section 57A of the first ultraviolet light irradiation device 51.

Therefore, a period of time may elapse from the time ink is cured by the first ultraviolet light irradiation device 51 until the ink is cured by the second ultraviolet light irradiation device 52. Furthermore, the aforementioned time period would not exceed a time period beyond that which is necessary to perform the curing of the ink. Accordingly, in printing with both of the first and second ultraviolet light irradiation devices 51 and 52, the quality of the print finish may improve.

As illustrated in FIG. 3, the ink jet printer 1 is equipped with the coupling mechanism 30 for freely detaching the cutting head 70 and the ink head 40. The coupling mechanism 30 is disposed at the rear of the first ultraviolet light irradiation device 51. Therefore, the size of ink jet printer 1 may be reduced.

It is noted that, in accordance with the present embodiment, the first ultraviolet light irradiation device 51 is disposed on the left of the ink head 40, and the second ultraviolet light irradiation device 52 is disposed on the right of the ink head 40. However, the first ultraviolet light irradiation device 51 may be disposed on the right of the ink head 40, and the second ultraviolet light irradiation device 52 may be disposed on the left of the ink head 40.

However, in accordance with the present embodiment, as shown in FIG. 2, the second ultraviolet light irradiation device 52 is positioned to the side of the ink head aiding system 99, and the first ultraviolet light irradiation device 51 is positioned to the side of the platen 25. For this reason, when the ink head 40 moves to the home position 200, the first ultraviolet light irradiation device 51 stays on the left side of the capping device 18, but the second ultraviolet light irradiation device 52 moves to the right side of the capping device 18.

As described above, the irradiation section 57B of the second ultraviolet light irradiation device 52 is disposed in a more forward position in comparison to the capping device 18. Therefore, curing of ink at the capping device 18 may be prevented even if the second ultraviolet light irradiation device 52 is unintentionally enabled.

As shown in FIG. 14B, the ink jet printer 1 is equipped with the lock mechanism 100 that fixes the ink head 40 at the home position 200, at least during a cutting operation. The lock mechanism 100 is disposed at the rear of the second ultraviolet light irradiation device 52. Accordingly, the size of the ink jet printer 1 may be reduced.

Only selected embodiments have been chosen to illustrate the present invention. To those skilled in the art, however, it will be apparent from the foregoing disclosure that various changes and modifications can be made herein without departing from the scope of the invention as defined in the appended claims. Furthermore, the foregoing description of the embodiments according to the present invention is provided for illustration only, and not for limiting the invention as defined by the appended claims and their equivalents.

What is claimed is:

1. An ink jet recording apparatus comprising:

a supporting member configured for supporting a recording medium;

a first transfer mechanism configured for transferring the recording medium supported by the supporting member in a first direction;

a guide rail extending in a second direction;

an ink head comprising a nozzle surface disposed opposite to the recording medium during a print operation, wherein at least one nozzle formed in the nozzle surface is configured for discharging ultraviolet light curable ink on the recording medium, wherein the ink head engages the guide rail in a moveable manner in the second direction along the guide rail;

a second transfer mechanism configured for transferring the ink head in the second direction;

a pair of ultraviolet light irradiation devices each of which is coupled to the ink head in a moveable manner in the second direction, each comprises an irradiation section disposed opposite to the recording medium during the print operation, and is configured for irradiating ultraviolet light onto the ultraviolet light curable ink that is the at least one nozzle; and an ink head aiding system comprising at least a wiper configured for wiping the nozzle surface of the ink head, a cap configured for covering the nozzle surface of the ink head, or a capping device, wherein one of the pair of ultraviolet light irradiation devices is located in front of the capping device.

2. The ink jet recording apparatus of claim 1, wherein an entire irradiation section of each pair of ultraviolet light irradiation devices is located in front of at least the wiper, the cap or the capping device of the ink head aiding system.

3. The ink jet recording apparatus of claim 2, wherein the ink head aiding system further comprises a container configured for collecting ink ejected from the at least one nozzle of the ink head.

4. The ink jet recording apparatus of claim 1, wherein a length in the first direction between a rear end of the irradiation section of each pair of ultraviolet light irradiation devices and a front end of the nozzle surface of the ink head is greater than a minimum feed amount of the recording medium.

5. The ink jet recording apparatus of claim 1, wherein:

the first direction is a front-rear direction; and the second direction is a left-right direction.

6. An ink jet recording apparatus comprising:

a supporting member configured for supporting a recording medium;

a first transfer mechanism configured for transferring the recording medium supported by the supporting member in a first direction;

a guide rail that extends in a second direction;

an ink head comprising a nozzle surface disposed opposite to the recording medium during a print operation, wherein at least one nozzle formed in the nozzle surface is configured for discharging ultraviolet light curable ink on the recording medium, wherein the ink head engages the guide rail in a moveable manner in the second direction along the guide rail;

a second transfer mechanism configured for transferring the ink head in the second direction;

first and second ultraviolet light irradiation devices coupled to the ink head in a moveable manner and comprising irradiation sections disposed opposite to the recording medium during the print operation, wherein the irradiation sections are configured for irradiating ultraviolet light onto the ultraviolet light curable ink discharged by the at least one nozzle; and an ink head aiding system comprising at least a wiper configured for wiping the nozzle surface of the ink head, a cap configured for covering the nozzle surface of the ink head, or a capping device, wherein:

at least a first portion of the irradiation section of the second ultraviolet light irradiation device is located in front of the irradiation section of the first ultraviolet light irradiation device; and either the first or second ultraviolet light irradiation device is located in front of the capping device.

7. The ink jet recording apparatus of claim 6, further comprising:

a control device configured for controlling the first ultraviolet light irradiation device to change from a light-on state to a light-off state when the ink head moves from a first position opposing the supporting member to a second position opposing at least the wiper, the cap or the capping device of the ink head aiding system.

8. The ink jet recording apparatus of claim 7, wherein the control device is further configured to control the first ultraviolet light irradiation device to change from a light-on state to a light-off state before the irradiation section of the first ultraviolet light irradiation device reaches the second position.

9. The ink jet recording apparatus of claim 6, further comprising:

a control device configured to change the first ultraviolet light irradiation device from a light-on state to a light-off state after the ink head moves from a position opposing the supporting member and before at least a portion of the irradiation section of the first ultraviolet light irradiation device reaches a position opposing at least the wiper, the cap or the capping device of the ink head aiding system.

10. The ink jet recording apparatus of claim 6, further comprising:

a control device configured to change the first ultraviolet light irradiation device from a light-off state to a light-on state when the ink head moves from a position opposing at least the wiper, the cap or the capping device of the ink head aiding system and the irradiation section of the first ultraviolet light irradiation device leaves a position opposing at least the wiper, the cap or the capping device of the ink head aiding system.

11. The ink jet recording apparatus of claim 6, further comprising:

a control device configured to change the first ultraviolet light irradiation device from a light-off state to a light-on state when the ink head moves from a position opposing at least the wiper, the cap or the capping device of the ink head aiding system and at least a portion of the irradiation section of the first ultraviolet light irradiation device leaves a position opposing at least the wiper, the cap or the capping device of the ink head aiding system.

12. The ink jet recording apparatus of claim 6, further comprising:

a control device configured for:

controlling the second transfer mechanism during the print operation for moving the ink head along the guide rail; and reversing a direction of movement off the ink head before the irradiation section of the first ultraviolet light irradiation device reaches a position opposing at least the wiper, the cap or the capping device of the ink head aiding system.

13. The ink jet recording apparatus of claim 6, further comprising:

a control device configured for:

controlling the second transfer mechanism during the print operation for moving the ink head along the guide rail; and reversing a direction of movement of the ink head before at least a portion of the irradiation section of the first ultraviolet light irradiation device reaches a position opposing at least the wiper, the cap or the capping device of the ink head aiding system.

14. The ink jet recording apparatus of claim 6, wherein a length in the first direction between a rear end of the irradiation section of the ultraviolet light irradiation device and a front end of the nozzle surface of the ink head is greater than a minimum feed amount of the recording medium.

15. The ink jet recording apparatus of claim 6, further comprising:

a cutting head comprising a cutter disposed opposite to the recording medium, configured for cutting the recording medium during a cut operation, and coupled to the guide rail in a moveable manner for moving along the guide rail in the second direction; and a coupling mechanism disposed at arear of the first ultraviolet light irradiation device or the second ultraviolet light irradiation device, wherein the coupling mechanism is configured for detachably coupling the cutting head and the ink head, such that the coupling mechanism connects the cutting head and the ink head during the printing operation and releases the connection between the cutting head and the ink head during the cut operation, wherein the second transfer mechanism is equipped with a carriage configured for transferring the cutting head in the second direction.

16. The ink jet recording apparatus of claim 6, wherein:

the second ultraviolet light irradiation device is disposed on the ink head towards a first end section of the guide rail; and the first ultraviolet light irradiation device is disposed on the ink head towards a second end of the guide rail.

17. The ink jet recording apparatus of claim 6, further comprising:

a main body configured for supporting the supporting member and the guide rail; and a lock mechanism disposed at a rear of the second ultraviolet light irradiation device and configured for affixing the ink head to the main body during a cut operation.

18. The ink jet recording apparatus of claim 6, wherein:

the first direction is a front-rear direction; and the second direction is a left-right direction.

19. A method of printing via an ink jet recording apparatus, the method comprising:

supporting a recording medium via a supporting member;

transferring the recording medium via a first transfer mechanism in a first direction;

discharging ultraviolet light curable ink via at least one nozzle formed in a nozzle surface of an ink head disposed opposite to the recording medium during a print operation, wherein the ink head engages a guide rail extending in a second direction and the ink head moves in the second direction along the guide rail in a moveable manner via a second transfer mechanism;

irradiating ultraviolet light onto the ultraviolet light curable ink discharged the at least one nozzle via an irradiation section of each pair of ultraviolet light irradiation devices coupled to the ink head and disposed opposite to the recording medium during the print operation; and changing each pair of ultraviolet light irradiation devices from a light-on state to a light-off state after the ink head moves from a position opposing the supporting member and before at least a portion of the irradiation section of each pair of ultraviolet light irradiation devices reaches a position opposing at least one element of an ink head aiding system, wherein one of the pair of ultraviolet light irradiation devices is located in front of a capping device.

20. The printing method of claim 19, further comprising:

changing each pair of ultraviolet light irradiation devices from a light-off state to a light-on state when the ink head moves from a position opposing the at least the wiper, the cap or the capping device of the ink head aiding system and the at least a portion of the irradiation section of each pair of ultraviolet light irradiation devices leaves a position opposing the at least the wiper, the cap or the capping device of the ink head aiding system.

21. The printing method of claim 19, wherein:

the first direction is a front-rear directions; and the second direction is a left-right direction.

* * * * *